US012564234B2

(12) United States Patent
Lybarger

(10) Patent No.: US 12,564,234 B2
(45) Date of Patent: Mar. 3, 2026

(54) SUN SHIELD

(71) Applicant: Kevin R. Lybarger, Richards, TX (US)

(72) Inventor: Kevin R. Lybarger, Richards, TX (US)

( * ) Notice: Subject to any disclaimer, the term of this patent is extended or adjusted under 35 U.S.C. 154(b) by 0 days.

(21) Appl. No.: 17/395,142

(22) Filed: Aug. 5, 2021

(65) Prior Publication Data

US 2021/0368903 A1 Dec. 2, 2021

Related U.S. Application Data

(63) Continuation-in-part of application No. 16/269,812, filed on Feb. 7, 2019, now abandoned, which is a continuation-in-part of application No. 16/011,137, filed on Jun. 18, 2018, now abandoned.

(60) Provisional application No. 62/521,951, filed on Jun. 19, 2017.

(51) Int. Cl.
*A42B 1/0187* (2021.01)
*A42B 1/241* (2021.01)
*A42B 1/244* (2021.01)

(52) U.S. Cl.
CPC ..... *A42B 1/0187* (2021.01); *A42B 1/241* (2013.01); *A42B 1/244* (2013.01); *Y10T 24/3485* (2015.01)

(58) Field of Classification Search
CPC ..... A42B 1/0187; A42B 1/244; A42B 1/24; A42B 1/0184; A42B 1/0186; Y10T 24/3485; Y10T 24/3499; Y10T 24/3487
USPC ..... D11/78.1; 24/139, 4
See application file for complete search history.

(56) References Cited

U.S. PATENT DOCUMENTS 1,392,715 A * 10/1921 Sommer ..... A45F 5/02 24/3.12
1,587,681 A * 6/1926 Schumacher ..... A42B 1/18 2/175.6
1,947,786 A * 2/1934 Lueck ..... A42B 3/225 2/10
2,095,340 A * 10/1937 Meyer ..... A44B 11/04 2/268
2,320,067 A * 5/1943 Caughren ..... A01M 31/006 224/268
2,416,062 A * 2/1947 Mercer ..... A42B 1/205 2/200.1
2,446,288 A * 8/1948 Lindley ..... A42B 1/0187 2/195.5
3,113,754 A * 12/1963 Jansson ..... F16L 3/12 248/74.3
3,521,332 A * 7/1970 Kramer ..... F16L 3/13 248/912
3,983,602 A * 10/1976 Barry ..... B43K 23/001 24/339
4,276,657 A * 7/1981 Montesi ..... A42B 3/185 2/10
4,316,289 A * 2/1982 Hild ..... A42B 3/227 2/10

(Continued)

*Primary Examiner* — Heather Mangine
(74) *Attorney, Agent, or Firm* — Kearney, McWilliams & Davis, PLLC; Dileep Rao

(57) ABSTRACT

A sun shield configured to be attached to a cap. The sun shield can have a brim, and a plurality of clips, wherein each clip is adapted to fasten the brim to an edge of the cap. In embodiments each clip is adapted to position the brim substantially orthogonally to the cap. In embodiments each clip is adapted to position the brim extending outwardly from the cap in a manner that a wearer of the cap is shielded from the sun.

6 Claims, 12 Drawing Sheets

(56) References Cited

U.S. PATENT DOCUMENTS 5,035,004 A * 7/1991 Koester ..... A42B 1/004 2/9
5,046,195 A * 9/1991 Koritan ..... A41D 20/00 2/916
5,081,717 A * 1/1992 Shedd ..... A42B 1/0187 2/181.4
5,105,476 A * 4/1992 Cox ..... A61F 9/045 2/DIG. 11
5,121,507 A * 6/1992 Brown ..... A42B 1/004 2/172
5,153,943 A * 10/1992 Clement ..... A42B 1/0187 2/418
5,189,265 A * 2/1993 Tilkens ..... A42B 1/004 181/136
5,201,077 A * 4/1993 Dondlinger ..... A42B 1/0187 2/172
5,212,837 A * 5/1993 Gose ..... A42B 3/105 2/916
5,463,189 A * 10/1995 Deneke ..... H02G 3/26 24/336
5,471,684 A * 12/1995 Casale ..... A42B 1/0184 2/10
5,489,078 A * 2/1996 Risley ..... B60R 7/082 224/312
5,548,846 A * 8/1996 Bianchetti ..... A42B 1/0184 2/209.12
5,623,732 A * 4/1997 Olajide, Jr. ..... A42B 1/0187 2/202
5,640,742 A * 6/1997 White ..... A44C 3/001 24/3.12
5,655,225 A * 8/1997 Mathers ..... A42B 1/0187 2/172
5,685,017 A * 11/1997 Kraft ..... A42B 1/205 2/209.12
5,787,556 A * 8/1998 Terzian ..... A47F 5/0884 24/3.12
5,829,103 A * 11/1998 Allen ..... B43K 23/001 24/3.12
5,836,055 A * 11/1998 Cooper ..... A45D 40/00 24/339
5,862,520 A * 1/1999 Wyant ..... A42B 1/0182 2/10
5,862,523 A * 1/1999 Proctor ..... A42B 1/247 2/209.11
5,867,874 A * 2/1999 Simpson ..... A42B 1/24 24/3.12
5,901,380 A * 5/1999 Mishal ..... A42B 1/0187 2/202
D412,611 S * 8/1999 Simpson ..... D2/891
5,950,888 A * 9/1999 Nolan-Brown ..... A47D 15/00 224/172
6,044,495 A * 4/2000 Ellman ..... A42B 1/0184 2/209.13
6,081,922 A * 7/2000 Wright ..... A61F 9/045 2/200.3
6,141,838 A * 11/2000 Cooper ..... A45D 42/02 24/339
6,370,696 B1 * 4/2002 Kronenberger ..... A42B 1/0182 40/329
6,374,423 B1 * 4/2002 Anderson ..... A63B 71/10 2/209.12
6,438,760 B1 * 8/2002 Wakefield ..... A42B 1/004 99/421 A
6,477,744 B1 * 11/2002 Miles ..... B43K 23/002 24/3.12
6,484,323 B1 * 11/2002 Pu ..... A42B 1/24 2/171.1
D471,709 S * 3/2003 Coyne ..... D3/266
D478,805 S * 8/2003 Winig ..... D8/367
6,691,374 B2 * 2/2004 Coyne ..... A45F 5/02 24/336
6,694,525 B1 * 2/2004 Murnan ..... A42B 3/227 2/421
D503,430 S * 3/2005 Chang ..... D19/83
6,996,852 B1 * 2/2006 Cabrera ..... A42B 1/24 2/172
7,000,841 B2 * 2/2006 Becker ..... A42B 1/244 2/10
7,051,406 B1 * 5/2006 Morris ..... G02C 3/02 24/3.12
7,310,829 B1 * 12/2007 Engel-Wilson ..... A42B 1/0187 2/209.13
7,866,813 B2 * 1/2011 Anhalt ..... A42B 1/247 2/209.13
8,024,818 B1 * 9/2011 Davenport ..... A42B 1/0187 2/172
8,091,845 B2 * 1/2012 Di Lollo ..... A47J 47/16 248/176.1
8,286,265 B2 * 10/2012 Karwan ..... A42B 1/004 2/175.1
8,850,618 B2 * 10/2014 Wu ..... A42B 1/201 2/171.03
8,918,916 B1 * 12/2014 Kang ..... A42B 1/18 2/209.13
D730,628 S * 6/2015 Peterson ..... D2/891
9,277,778 B1 * 3/2016 Fulper ..... A42B 1/0184
9,341,285 B2 * 5/2016 Magno, Jr. ..... F16L 3/10
D761,001 S * 7/2016 Kouns ..... D2/895
D835,542 S * 12/2018 Lybarger ..... D11/78.1
10,539,267 B2 * 1/2020 Olsen ..... F16M 13/022
10,847,960 B1 * 11/2020 Naugler ..... H01R 4/64
2002/0000001 A1 * 1/2002 Hall McKenzie ... A42B 1/0184 2/207
2003/0126722 A1 * 7/2003 Thompson ..... B60J 3/0204 24/3.12
2003/0172437 A1 * 9/2003 Guerra ..... A42B 1/24 2/171
2004/0052068 A1 * 3/2004 Chien ..... A42B 3/044 362/209
2005/0078473 A1 * 4/2005 Zuloff ..... A42B 1/004 362/106
2005/0108857 A1 * 5/2005 Wartian ..... B43K 23/002 24/10 R
2005/0223525 A1 * 10/2005 Wartian ..... B43K 23/002 24/336
2006/0143799 A1 * 7/2006 Young ..... A42B 1/22 2/209.13
2006/0174398 A1 * 8/2006 Proctor ..... A42B 1/22 2/209.13
2007/0240287 A1 * 10/2007 McIntyre ..... A42B 1/0187 24/329
2008/0115258 A1 * 5/2008 Hernandez ..... A42B 1/0184 2/209.12
2008/0152435 A1 * 6/2008 Heindl ..... E02D 5/06 405/274
2009/0172866 A1 * 7/2009 Chang ..... A42B 1/242 2/209.12
2010/0162471 A1 * 7/2010 Tsai ..... A42B 3/061 2/410
2010/0254123 A1 * 10/2010 Brown ..... A42B 1/244 248/316.7
2011/0078843 A1 * 4/2011 Kennedy ..... A42B 1/241 2/209.13
2012/0005795 A1 * 1/2012 Tilley ..... A42B 3/227 2/10
2012/0180193 A1 * 7/2012 Curiel ..... A42B 1/201 2/209.11
2012/0272483 A1 * 11/2012 Moore ..... F16B 2/22 24/3.12
2013/0117973 A1 * 5/2013 Murasaki ..... B68G 7/12 24/581.11
2013/0174322 A1 * 7/2013 Williams ..... A42B 1/248 2/181
2013/0180031 A1 * 7/2013 Bullock ..... A42B 1/0187 2/243.1
2014/0137312 A1 * 5/2014 Charest ..... A42B 1/0187 2/209.11

(56) References Cited

U.S. PATENT DOCUMENTS

2014/0310853 A1* 10/2014 Miles ..... A42B 1/0187 2/172
2014/0338097 A1* 11/2014 Kay ..... A42B 1/248 2/195.1
2015/0059054 A1* 3/2015 Peterson ..... A42B 1/0187 2/172
2015/0164206 A1* 6/2015 Reed ..... A45F 5/021 24/3.12
2015/0327613 A1* 11/2015 Kay ..... A42B 1/242 2/209.13
2015/0358515 A1* 12/2015 Resnick ..... G03B 17/561 24/3.12
2016/0100646 A1* 4/2016 Bradford ..... A42B 1/18 2/209.13
2016/0128411 A1* 5/2016 Ayres ..... A42B 1/008 2/172
2016/0203663 A1* 7/2016 Proctor ..... G07C 9/28 340/5.61
2017/0164676 A1* 6/2017 Henrickson ..... A42B 1/24
2017/0245574 A1* 8/2017 Danko ..... A42B 3/0406
2017/0262884 A1* 9/2017 Miller ..... A41D 1/002
2017/0280805 A1* 10/2017 Zhang ..... G06F 3/0488
2017/0325532 A1* 11/2017 Gerpheide ..... F21S 9/037
2017/0347733 A1* 12/2017 Durand, Jr. ..... A42B 1/0184
2018/0146734 A1* 5/2018 Kelly ..... A42B 1/004
2018/0193710 A1* 7/2018 Jernigan ..... A63B 57/203
2018/0199648 A1* 7/2018 Burton ..... A41D 13/0512
2018/0360150 A1* 12/2018 Lybarger ..... A42B 1/0186
2019/0166940 A1* 6/2019 Lybarger ..... A42B 1/0187
2020/0268086 A1* 8/2020 Pruett ..... A42B 1/24
2021/0093032 A1* 4/2021 Pakula, Jr. ..... A42B 1/18
2021/0100307 A1* 4/2021 Sunseri ..... A42B 1/201
2021/0368903 A1* 12/2021 Lybarger ..... A42B 1/244
2022/0142281 A1* 5/2022 Kuenzler ..... A42B 1/24
2022/0256959 A1* 8/2022 Greenberger ..... A42B 1/24

* cited by examiner

FIG. 5A
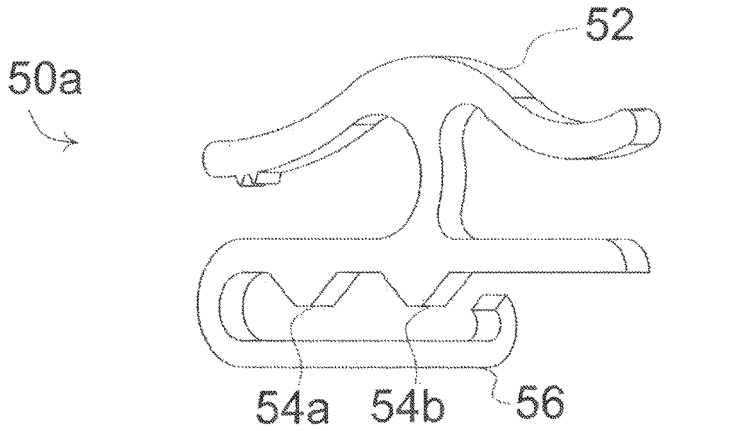
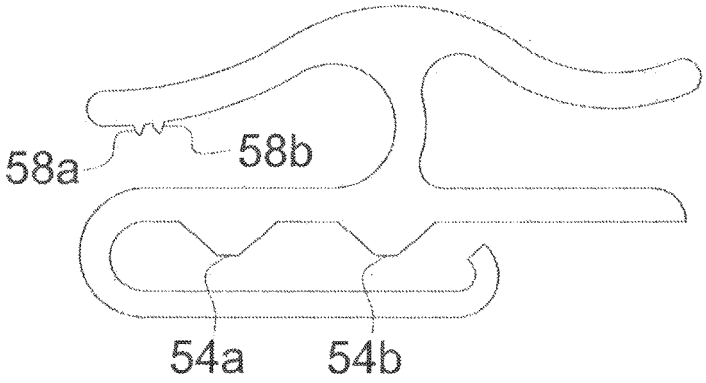
FIG. 5C

SUN SHIELD

CROSS REFERENCE TO RELATED APPLICATIONS

The present application is a Continuation in Part and claims priority to and the benefit of U.S. Nonprovisional patent application Ser. No. 16/269,812 filed on Feb. 7, 2019, titled "HAT WITH DETACHABLE AND RE-ADJUSTABLE CANCER REDUCING SAFETY HEAD GEAR," which is a Continuation in Part of U.S. Nonprovisional patent application Ser. No. 16/011,137 filed on Jun. 18, 2018, now abandoned, which claimed priority to and benefit of U.S. Provisional Patent Application Ser. No. 62/521,951 filed on Jun. 19, 2017, both titled "DETACHABLE AND RE-ADJUSTABLE CANCER REDUCING SAFETY HEADWEAR." These references are hereby incorporated in their entirety.

FIELD

The present disclosure generally relates to a sun shield.

BACKGROUND

People who work outdoors are often exposed to the elements for extended periods of time. Specifically, excessive sun exposure can lead to many undesirable outcomes, such as heat stroke or melanomas.

Many caps or hats currently provide a bill for protecting the face of a user, but the bill does not extend fully around the head. This leaves many areas of a user exposed to sunlight even while wearing a cap or a hat.

It is desirable to protect the entire head and neck of a user from sunlight.

The present disclosure addresses the deficiencies of many caps and hats and provides a sun shield configured for attachment to a cap or a hat.

BRIEF DESCRIPTION OF THE DRAWINGS

The detailed description will be better understood in conjunction with the accompanying drawings as follows:

FIGS. 5A-5D depict a slip clip according to one or more embodiments.

Figure 1A:
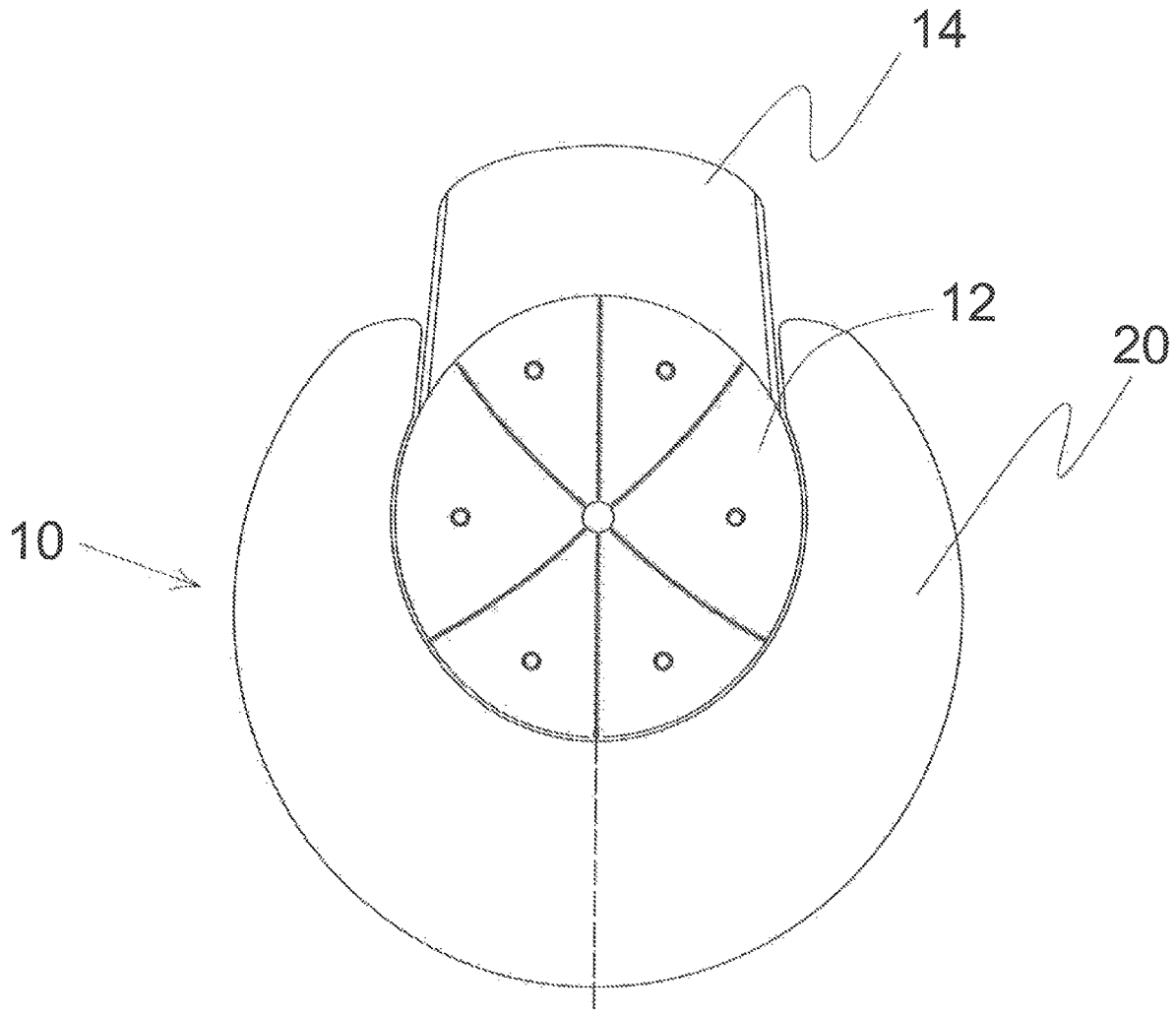
FIGS. 1A and 1B depict a top view of an embodiment of a cap with a sun shield according to one or more embodiments.

Embodiments of the present disclosure are detailed below with reference to the listed Figures.

DETAILED DESCRIPTION OF THE EMBODIMENTS

Before explaining the present disclosure in detail, it is to be understood that the disclosure is not limited to the specifics of particular embodiments as described and that it can be practiced, constructed, or carried out in various ways.

While embodiments of the disclosure have been shown and described, modifications thereof can be made by one skilled in the art without departing from the spirit and teachings of the disclosure. The embodiments described herein are exemplary only, and are not intended to be limiting.

Specific structural and functional details disclosed herein are not to be interpreted as limiting, but merely as a basis of the claims and as a representative basis for teaching persons having ordinary skill in the art to variously employ the present embodiments. Many variations and modifications of embodiments disclosed herein are possible and are within the scope of the present disclosure.

Where numerical ranges or limitations are expressly stated, such express ranges or limitations should be understood to include iterative ranges or limitations of like magnitude falling within the expressly stated ranges or limitations.

The use of the word "a" or "an" when used in conjunction with the term "comprising" in the claims and/or the specification may mean "one," but it is also consistent with the meaning of "one or more," "at least one," and "one or more than one."

The word "about", when referring to values, means plus or minus 5% of the stated number.

The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

When methods are disclosed or discussed, the order of the steps is not intended to be limiting, but merely exemplary unless otherwise stated.

Accordingly, the scope of protection is not limited by the description herein, but is only limited by the claims which follow, encompassing all equivalents of the subject matter of the claims. Each and every claim is hereby incorporated into the specification as an embodiment of the present disclosure. Thus, the claims are a further description and are an addition to the embodiments of the present disclosure.

The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

The embodiments of the present disclosure generally relate to a sun shield. The sun shield is adapted to be attachable to a cap or a hat worn by a user.

For the purposes of this disclosure, the term cap shall be utilized to mean any head covering worn by a person, either with or without a brim. Exemplary caps include, but are not limited to hats, helmets, hoods, headscarves, wimples, turbans, wigs, and the like.

The sun shield is adapted to be attached to any edge of a cap, hat, headgear, or headwear. This can include any edge, such as the bill of a baseball cap. The sun shield can be attached to virtually any piece of headwear, including caps that are fitted, with snap closures, which are adjustable, and the like.

The sun shield is configured to be attached to a cap. The sun shield can have a brim, and a plurality of clips, wherein each clip is adapted to fasten the brim to an edge of the cap. In embodiments, each clip can be adapted to position the brim substantially orthogonally to the cap. In embodiments, each clip can be adapted to position the brim extending outwardly from the cap in a manner that a wearer of the cap is shielded from the sun.

While the intention is to position the brim substantially perpendicularly to the cap or the head of a user, variations in angle of the brim extending outward can be selected by persons having ordinary skill in the art based upon the application.

In embodiments, the sun shield can have a safety region, a reflective sticker, or a reflective coating disposed upon the brim.

In embodiments, a storage element can be disposed upon the brim.

Clips can be any known fastener used to position the sun shield with respect to the cap. Exemplary fasteners include but are not limited to buttons of various types, zippers, toggle fasteners, ball and socket snap closures (also known as poppers), buckles, braided loop fasteners, frog fasteners, hook and clip fasteners, clasp fasteners, grommet fasteners, hook and eye closures, hook and loop fasteners, combinations thereof, and the like.

Clips can also be a slip clip configured to position the brim substantially orthogonally to the cap. In embodiments, the angle of the brim can be adjusted by modifying the slip clip to a desired angle. In embodiments, a drape to cover the neck can also be attached to provide additional protection from the sun.

Figure 1B:
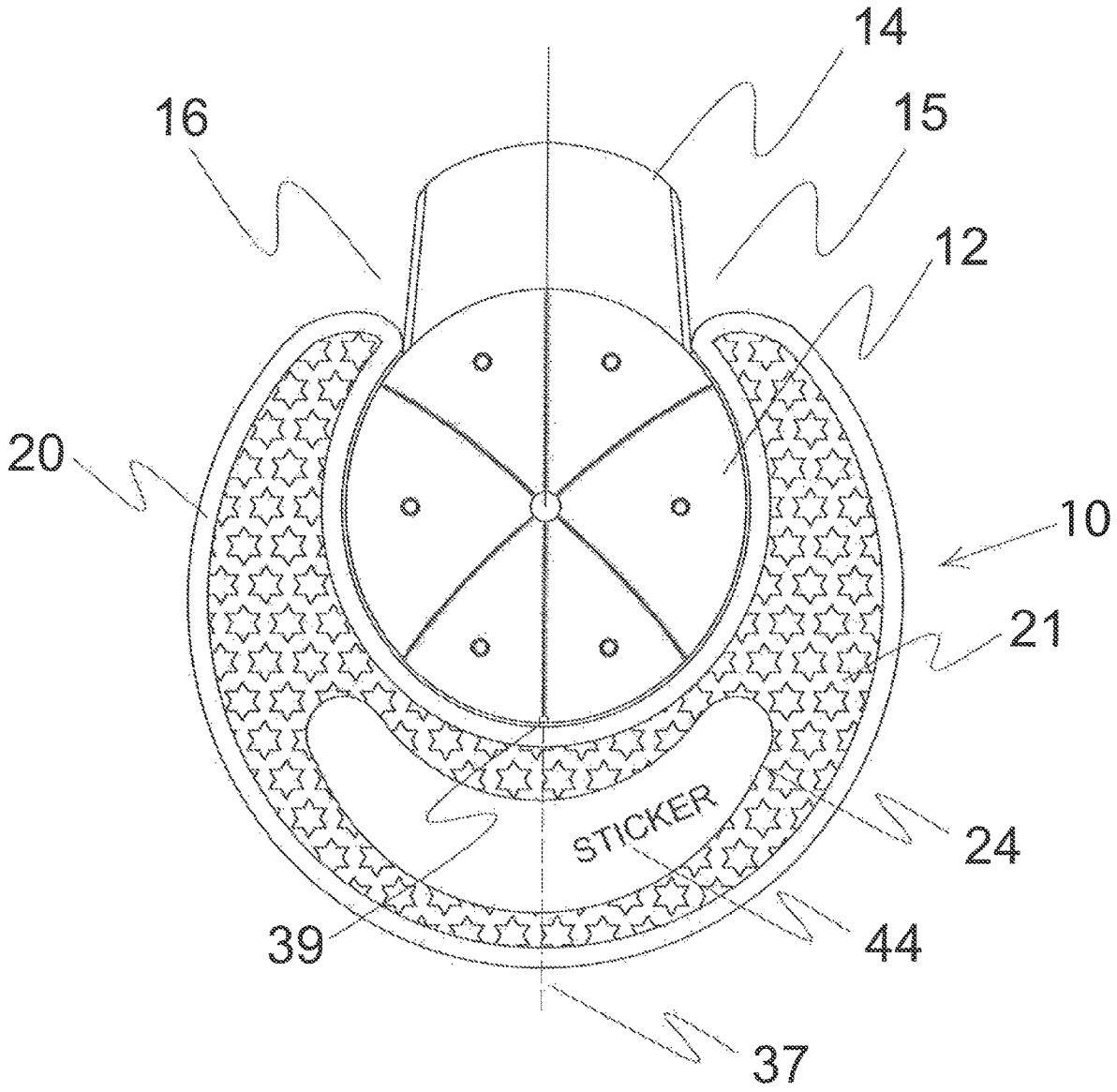
Figure 1C:
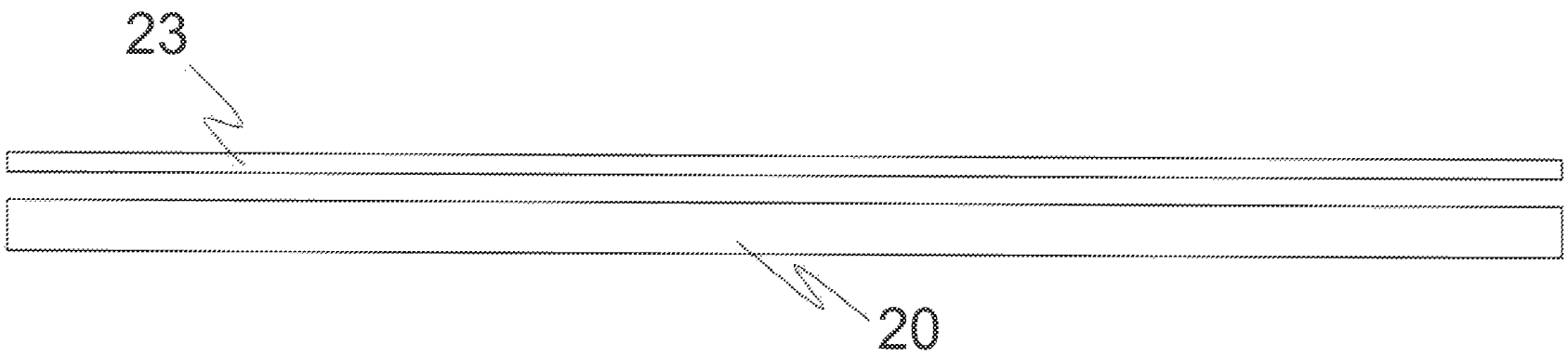
FIG. 1C depicts a side view of the sun shield according to one or more embodiments.

Turning now to the Figures, FIGS. 1A and 1B depict a top view and FIG. 1C depicts a side view of an embodiment of a cap with a sun shield according to one or more embodiments.

The cap shown is a baseball cap with has a cap portion 12 and a bill 14. The sun shield 10 has a brim 20 having a top side 21, a bottom side, and a safety region 24 on the top side 21. The brim 20 can be configured to surround the cap portion 12 from a first edge 15 of the bill 14 to a second edge 16 of the bill without covering the bill.

A fabric portion 23 can be used to cover all or a portion of the brim 20, such as a waterproof plastic sheet attached with adhesive. In embodiments, a safety region 24 can have a reflective sticker 44. The reflective sticker 44 can have a chemiluminescent feature or can have a micro-prismatic reflective sticker.

In embodiments, the brim 20 can be configured to surround the cap portion 12 of the sun shield 10 from an edge of the bill 14 without covering the bill.

Figure 3A:
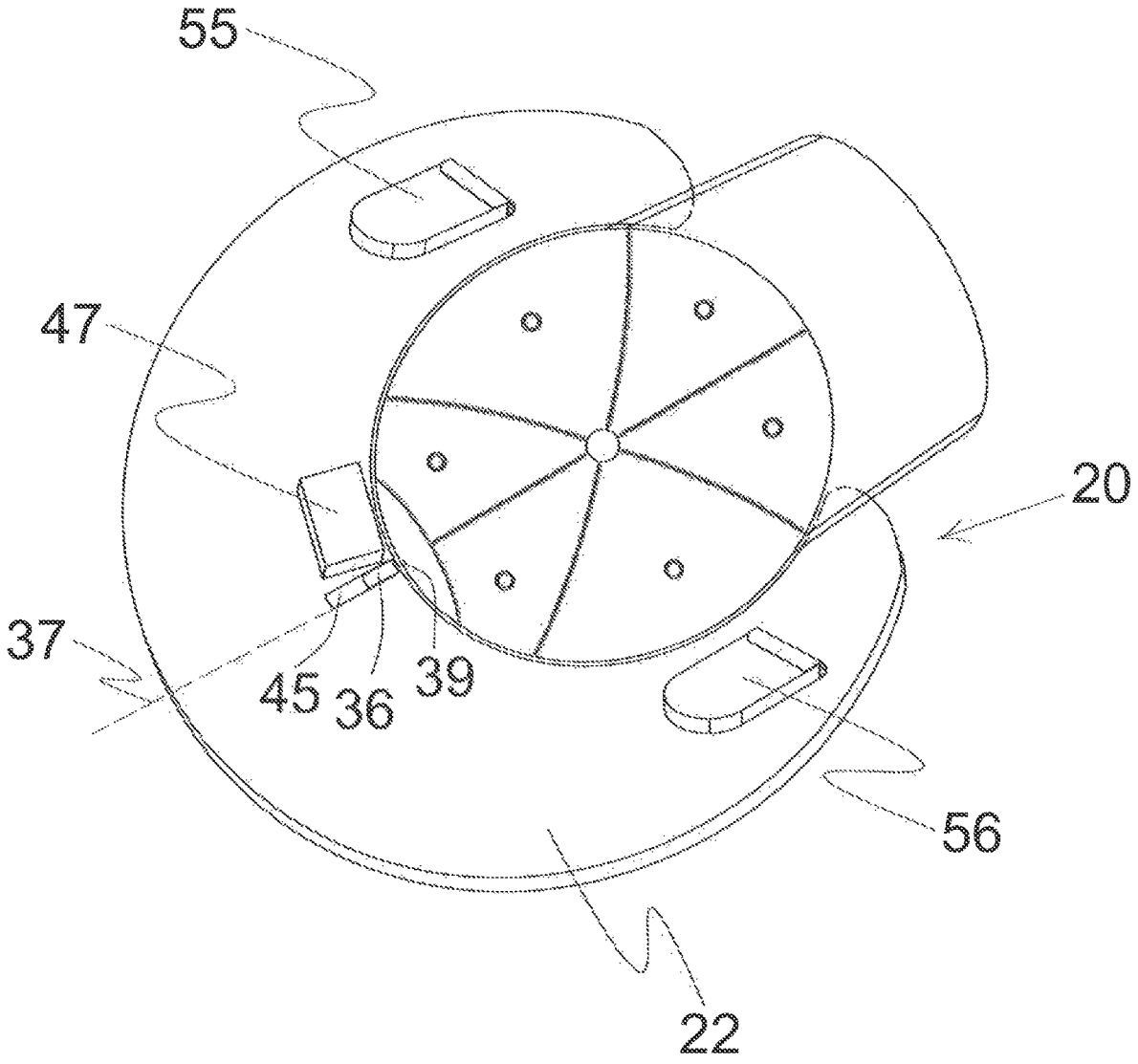
FIG. 3A depicts a bottom view of a cap with the sun shield according to one or more embodiments.

The sun shield is shown with a third connection 39, which can be fastened at a midpoint 37 to the brim 20 or cap portion, which is shown in greater detail in FIG. 3A.

Figure 2A:
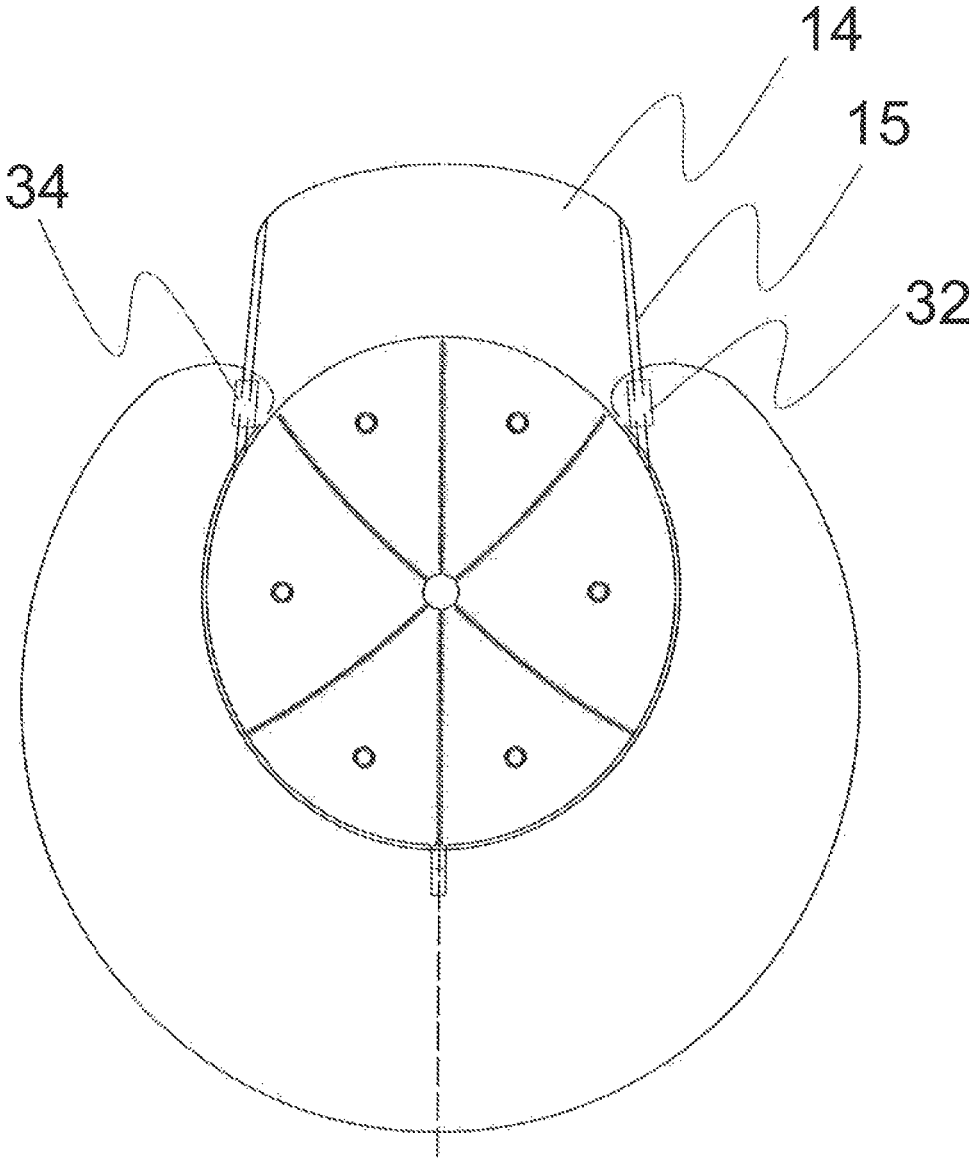
FIG. 2A depicts a top view of a cap with a sun shield according to one or more embodiments.

FIG. 2A depicts a top view of a cap with a sun shield according to one or more embodiments.

The sun shield can be fastened to the cap at the first edge 15 of the bill 14, or at an edge of the cap. Shown here is an embodiment with a first connection 32 and a second connection 34 fastened to the bill 14 of the cap portion 12.

Figure 2B:
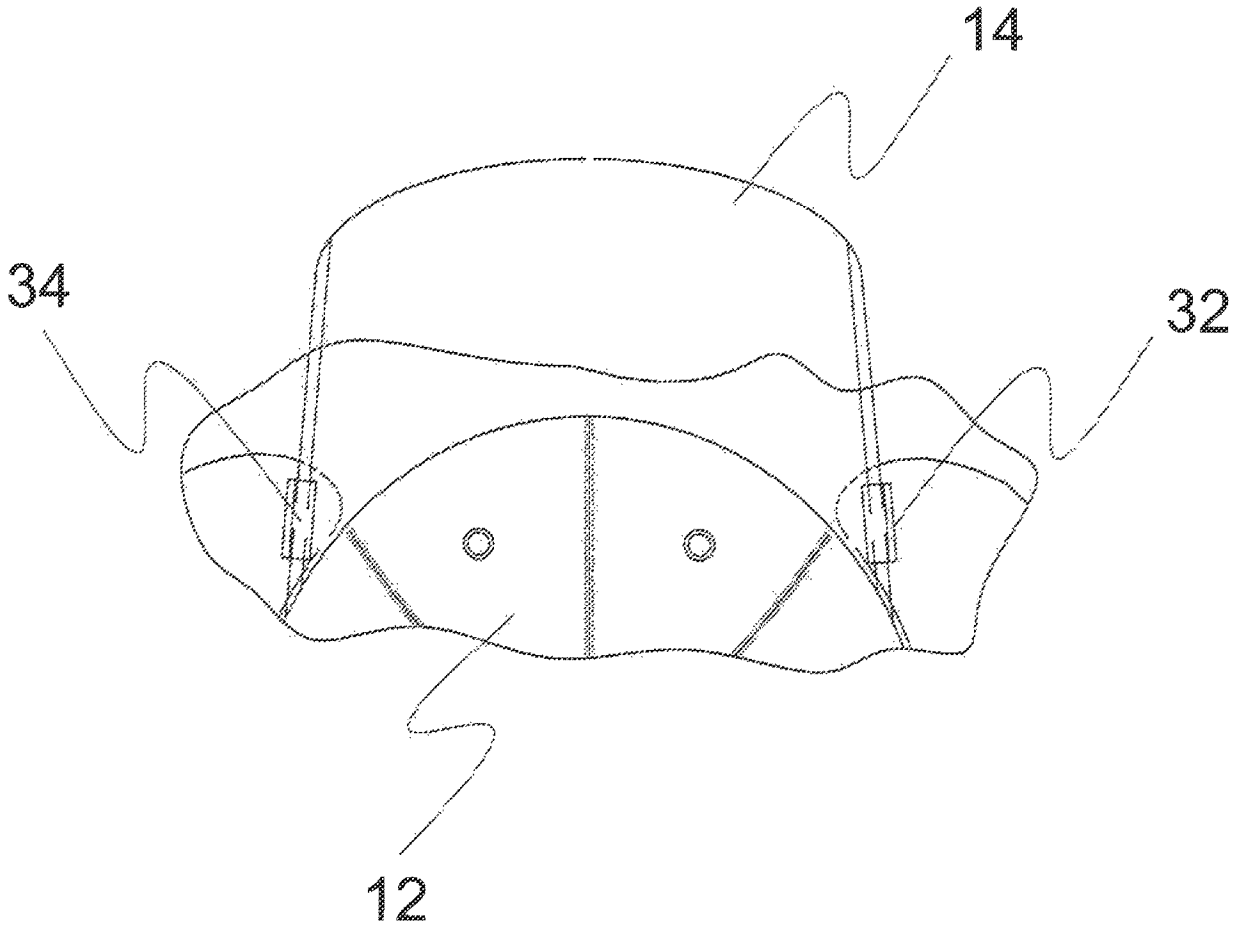
FIG. 2B depicts a bottom view of a cap with a sun shield according to one or more embodiments.

FIG. 2B depicts a bottom view of a cap with a sun shield according to one or more embodiments.

Shown here is the first connection 32 and the second connection 34 fastened to the bill 14 of the cap or cap portion 12.

FIG. 3A depicts a bottom view of a cap with the sun shield according to one or more embodiments.

The sun shield is shown with a third connection 39, which can be fastened at a midpoint 37 to the brim 20 or cap portion.

The third connection 39 can be a segment of elastic 45, which can be sewn onto the brim 20 that can further engage a hook and loop segment (such as VELCRO™), which can be sewn to the elastic segment for engaging a removable fastener.

In embodiments, a light 36 with a power supply 47 can be mountable to the bottom side 22 of the brim 20. In embodiments, the power supply 47 can be attached to the brim 20 and power the light.

The sun shield can have a closable storage element 55, such as for storing a driver's license, and/or credit cards. In embodiments, the sun shield can have an additional closable storage element 56, such as for keys.

Figure 3B:
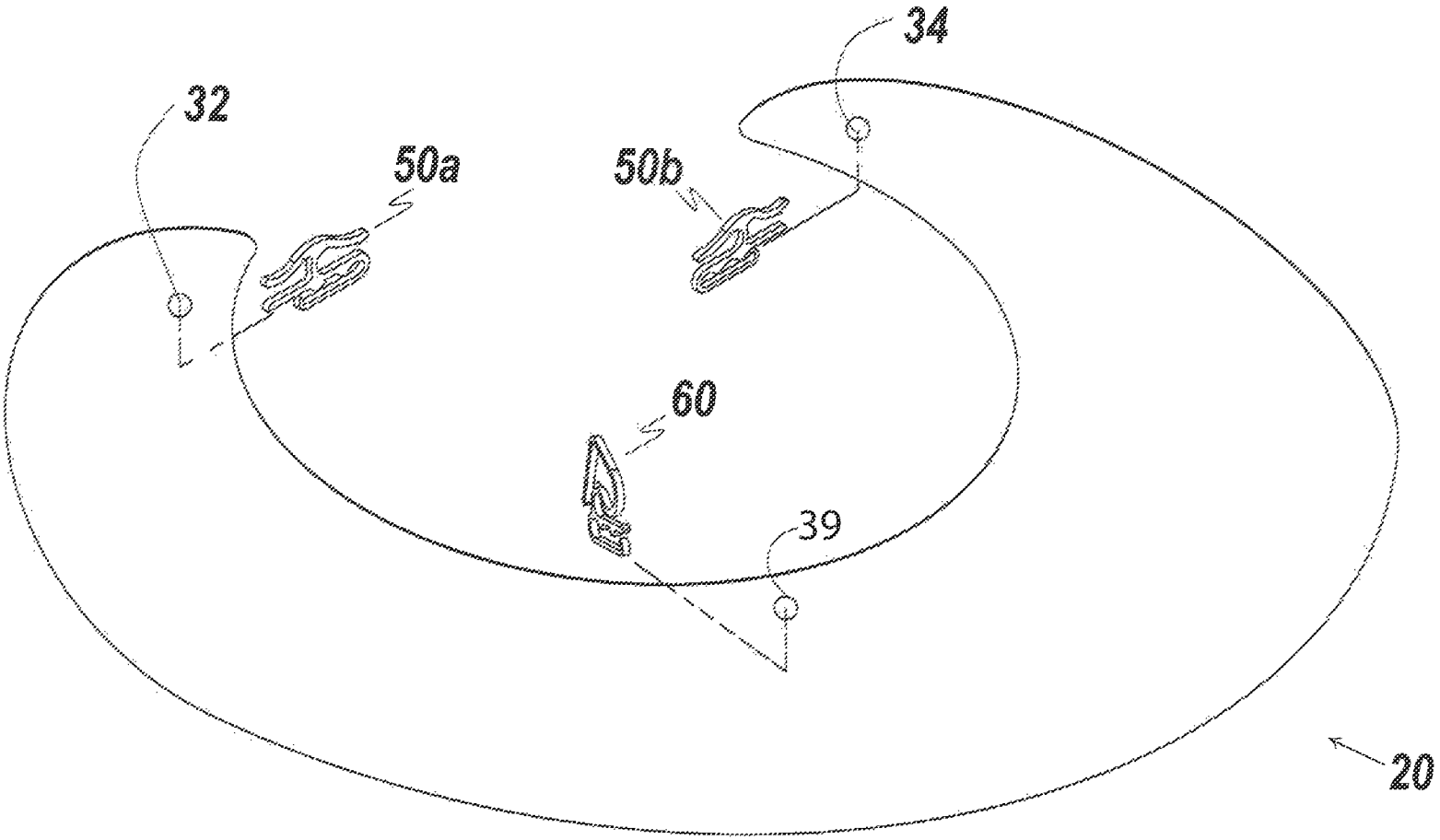
FIG. 3B depicts bottom view of the sun shield according to one or more embodiments.

FIG. 3B depicts bottom view of the sun shield according to one or more embodiments.

The brim 20 can have a first connection 32 engaging the bill or the edge of a cap and a second connection 34 engaging the bill or the edge of the cap simultaneously with the first connection. The connections can be located at any point on the bill, the cap, and/or the cap portion.

The brim 20 can have a first slip clip 50*a* secured to the first edge of the bill. A second slip clip 50*b* can be secured to the second edge of the bill simultaneously with the first connection.

In embodiments, the brim 20 can have a third connection 39. The third connection 39 can have a third slip clip 60, which can attach to the midpoint of the brim 20 to the cap portion while the first and second connections engage opposite sides of the bill.

Figure 4:
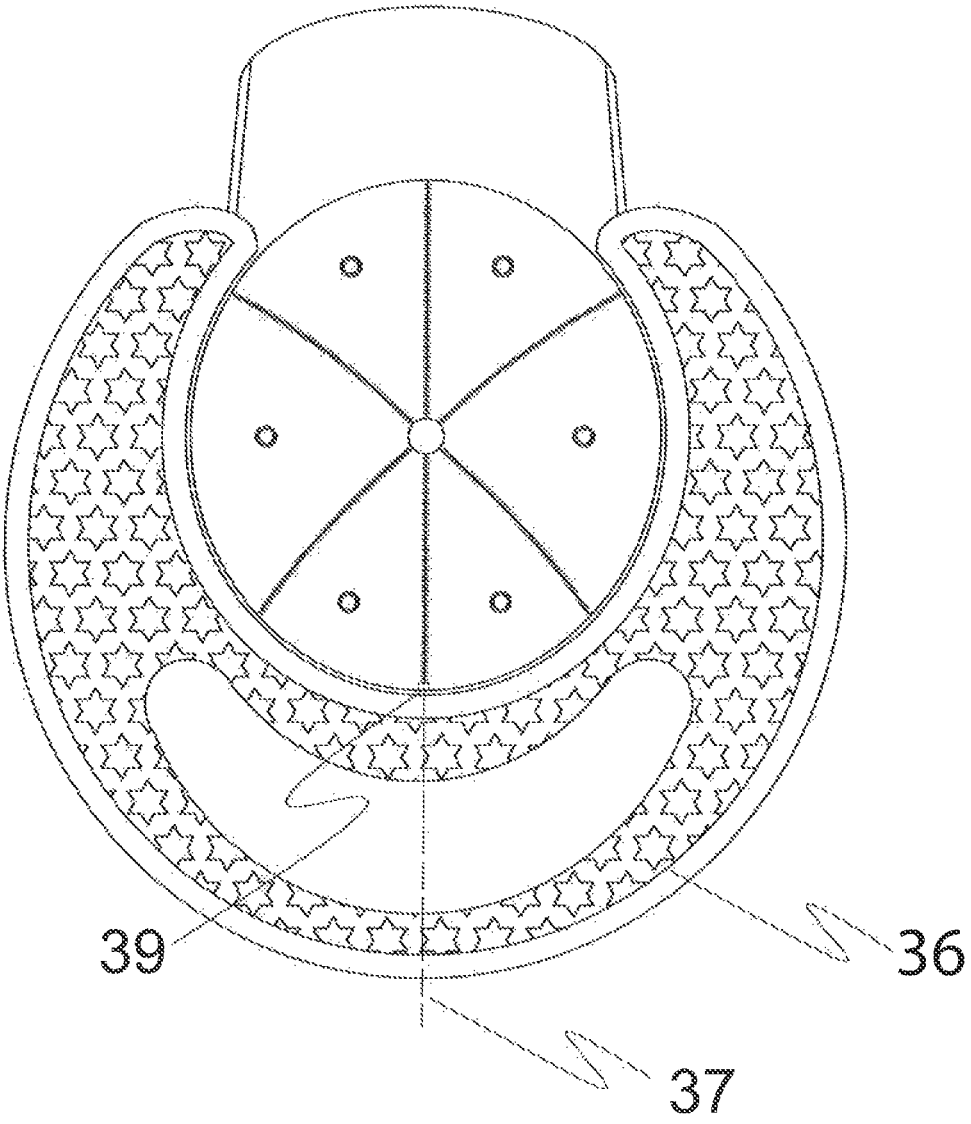
FIG. 4 is a top view of a cap with a sun shield and a light portion mounted on headwear according to one or more embodiments.

FIG. 4 is a top view of a cap with a sun shield and a light portion mounted on headwear according to one or more embodiments.

In embodiments, the light 36 can be disposed upon a perimeter of the brim, creating a safety lighting showing the location of a wearer. The light can be configured to illuminate in a variety of preset patterns when actuated by the wearer, based on a location of a wearer, or any other configuration as desired by persons having ordinary skill in the art.

FIGS. 5A-5D depict a slip clip according to one or more embodiments.

In embodiments, the slip clip 50*a* can have a curved top 52 with at least one top tooth 58*a*-58*b* on one end for making a connection with the edge of the bill.

In embodiments, each slip clip 50*a* can have a mid-portion having a stem. The stem can connect the curved top 52 to a hooked bottom 56. The hooked bottom 56 can have at least one bottom tooth 54*a*-54*b* for connecting each slip clip 50*a* to the brim of the sun shield.

Figure 5B:
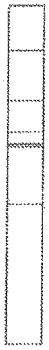
Figure 5D:
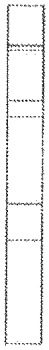

FIGS. 5B and 5D depict the side views of the slip clip according to one or more embodiments.

In embodiments, slip clip 50*a* can secure to the edge of the bill, the cap, or any outwardly extending portion of headwear as needed.

FIGS. 6A-6D depict a slip clip according to one or more embodiments.

In embodiments, the third slip clip 60 can have a curvilinear top 62 with at least one top tooth 64 for making a connection to the edge of the cap.

In embodiments, the third slip clip can have a hooked bottom 66 with at least one bottom tooth 68*a*-68*b* for connecting the third slip clip 60 to the brim of the sun shield.

Figures 6A, 6C:
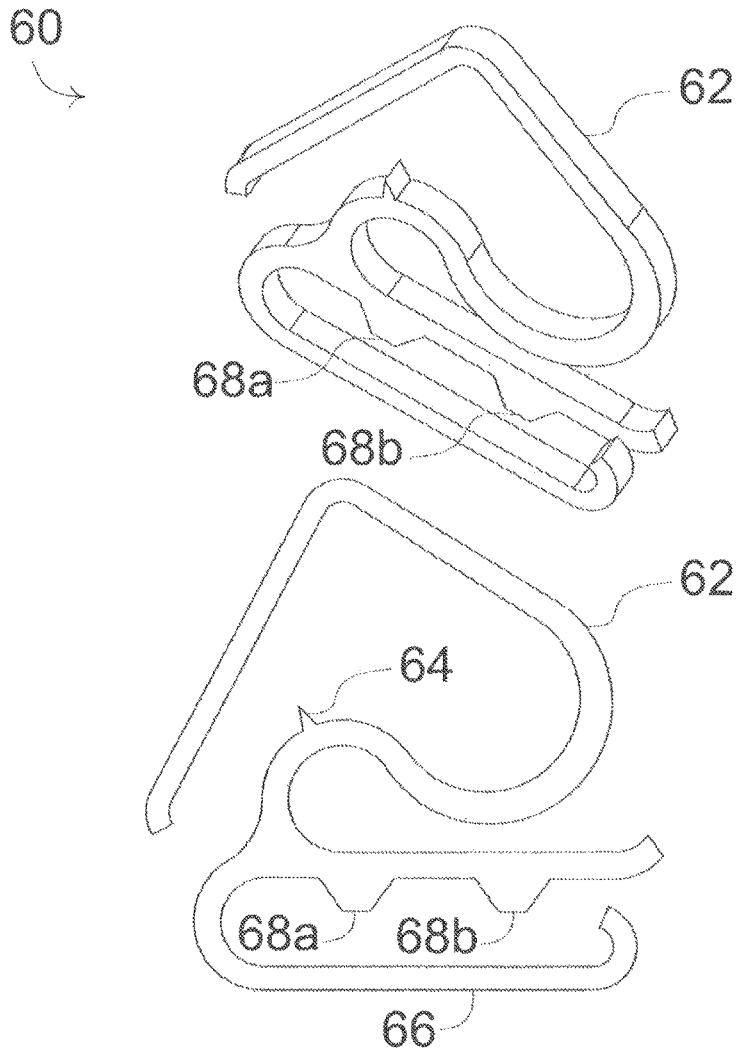
FIGS. 6A-6D depict a slip clip according to one or more embodiments.
Figure 6B:
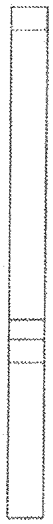
Figure 6D:
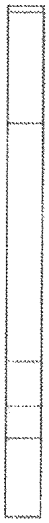

FIGS. 6B and 6D depict the side views of the additional slip clip according to one or more embodiments.

While the present disclosure emphasizes the presented embodiments and Figures, it should be understood that within the scope of the appended claims, the disclosure might be embodied other than as specifically enabled herein.

What is claimed is:

1. A sun shield configured to be attached to a cap, the sun shield comprising:

a brim configured to surround a crown of the cap and extend substantially orthogonally from a bottom edge of the crown of the cap when the sun shield and cap are worn on a head of a user;

a plurality of slip clips, comprising:

a first slip clip having a mid portion comprising a stem, the stem connected to a curved top portion having two arms extending outward on opposite sides of a top of the stem portion, and a bottom of the stem connected to a hooked bottom portion, wherein the hooked portion and the curved portion each comprise at least one protrusion for gripping;

wherein the hooked portion is connected linearly to the brim and one of the two legs of the curved top portion is configured to be connected linearly to a first side edge of a bill of the cap to position the brim substantially perpendicularly to the bottom edge of the crown of the cap and the head of the user when the sun shield and cap are worn on the head of the user;

a second slip clip having a mid portion comprising a stem, the stem connected to a curved top portion having two arms extending outward on opposite sides of a top of the stem portion, and a bottom of the stem connected to a hooked bottom portion, wherein the hooked portion and the curved portion each comprise at least one protrusion for gripping;

wherein the hooked portion is connected linearly to the brim and one of the two legs of the curved top portion is configured to be connected linearly to a second side edge of a bill of the cap to position the brim substantially perpendicularly to the bottom edge of the crown of the cap and the head of the user when the sun shield and cap are worn on the head of the user.

2. The sun shield of claim 1, further comprising a safety region disposed upon the brim.

3. The sun shield of claim 1, further comprising a reflective sticker or a reflective coating disposed upon the brim.

4. The sun shield of claim 1, further comprising a light disposed upon the brim.

5. The sun shield of claim 1, further comprising a storage element disposed upon the brim.

6. A method of using the sun shield according to claim 1, the method comprising:

a) providing the sun shield;

b) attaching the brim to the cap using at least the first and second slip clips of the plurality of slip clips;

c) positioning the brim substantially in a same orientation as the bill of the cap to provide shade entirely around the crown of the cap.

* * * * *